United States Patent [19]

Evers

[11] 4,338,082

[45] Jul. 6, 1982

[54] POSITIONING MECHANISM FOR SUPPORT ARM OF HEAT SEALING AND COOLING DEVICES

[75] Inventor: Jack R. Evers, Torrance, Calif.

[73] Assignee: Developak Corporation, Redondo Beach, Calif.

[21] Appl. No.: 152,715

[22] Filed: May 23, 1980

[51] Int. Cl.[3] ..... B31B 1/64

[52] U.S. Cl. ..... 493/190; 493/166; 493/247; 493/470

[58] Field of Search ..... 493/190, 189, 247, 246, 493/250, 252, 164, 166, 176, 175, 470

[56] References Cited

U.S. PATENT DOCUMENTS

| | | | |
|---|---|---|---|
| 2,196,666 | 4/1940 | Moore | 493/190 X |
| 2,966,832 | 1/1961 | Vergobbi | 493/252 X |
| 3,432,986 | 3/1969 | Schneider et al. | 493/190 X |
| 4,198,259 | 4/1980 | Van der Meulen | 493/190 X |
| 4,279,608 | 7/1981 | Evers | 493/250 X |

*Primary Examiner*—James F. Coan

*Attorney, Agent, or Firm*—Charles E. Brown

[57] ABSTRACT

This relates to a drive system for selectively positioning a heat sealer and a cooler relative to mandrels supporting bags or pouches, which mandrels are carried by a turret and indexed thereby. A simple oscillating shaft driven by a cam oscillates a double ended lever which, in turn, serves to oscillate wedge shaped cam members so as to simultaneously actuate two sets of heat sealers and coolers with each heat sealer and cooler being carried by a separate support arm.

9 Claims, 5 Drawing Figures

FIG. 3
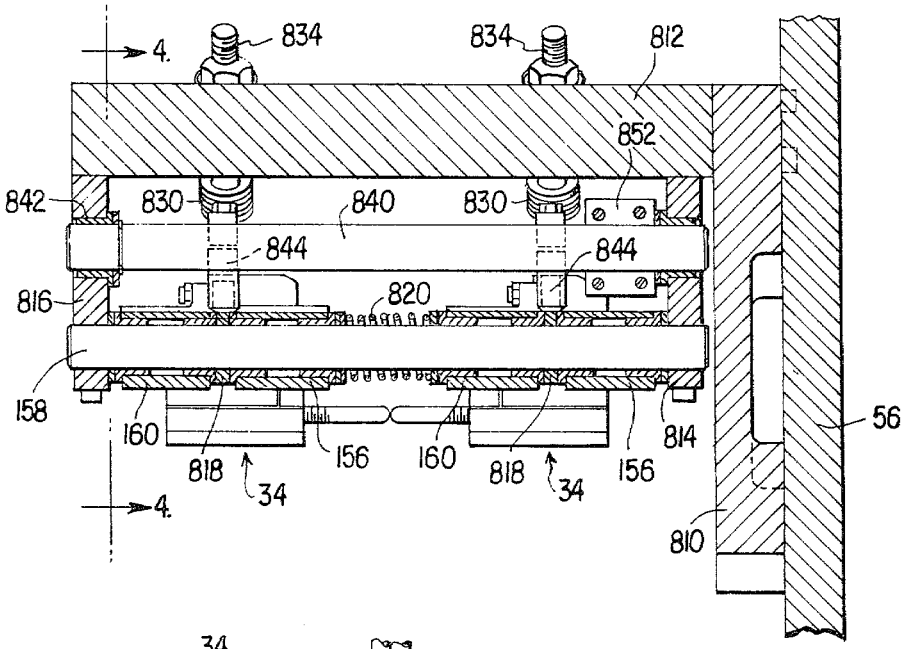
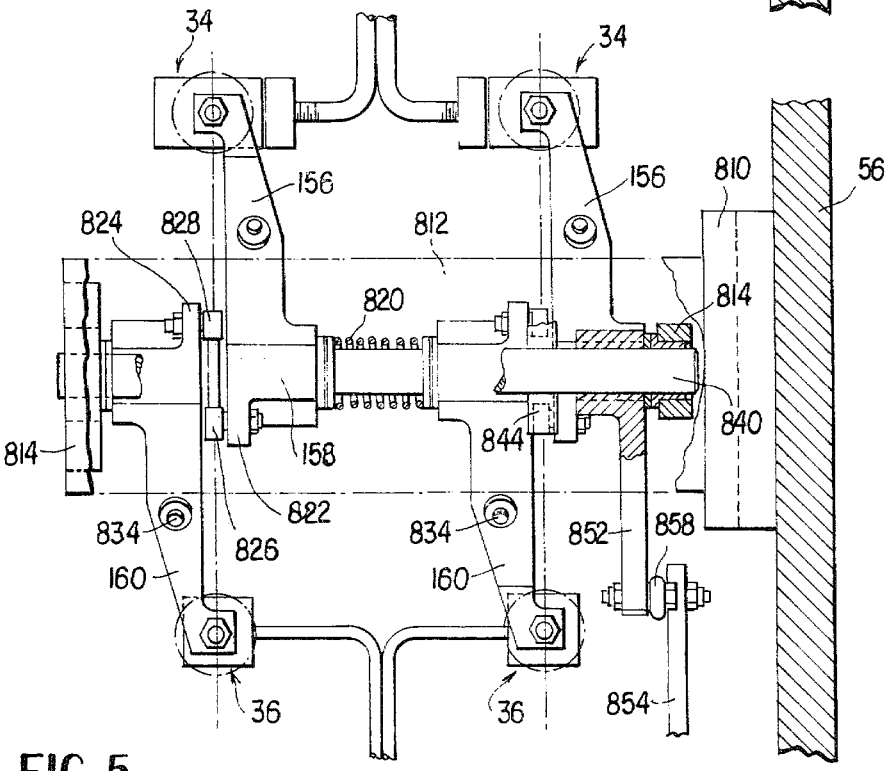
FIG. 5

POSITIONING MECHANISM FOR SUPPORT ARM OF HEAT SEALING AND COOLING DEVICES

This invention relates in general to positioning mechanisms, and more particularly to a mechanism for positioning support arms for heat sealing and cooling devices utilized in conjunction with a plastic bag forming machine.

Specifically, bags which have sealed ends are placed upon a turret for the sequential plowing of the bag bottom to a flattened state, followed by the alternate heat sealing, cooling, heat sealing and further cooling of flaps of the bag bottom. This invention has to do with the positioning mechanism for positioning the heat sealing and cooling devices in sequence with the indexing of the turret.

Most specifically, this invention has to do with a simple drive mechanism for simultaneously positioning two support arms which are mounted on a common pivot shaft. The support arms have extensions arranged in a V pattern with respect to the pivot shaft and there is associated therewith a positioning cam. The positioning cam is in the form of a simple wedge and then a drive shaft for the cam is oscillated, the support arms are first moved towards the turret and then away from the turret.

Further, there are two sets of the support arms in circumferentially spaced relation and there is a drive mechanism for each pair of support arms. The two drive mechanisms are interconnected by a cam driven linkage which serves to rotate the cams of the two sets of support arms in a like manner so as to obtain a simultaneous positioning of the support arms of the two sets of support arms in timed relation to the indexing of the associated turret.

With the above and other objects in view that will hereinafter appear, the nature of the invention will be more clearly understood by reference to the following detailed description, the appended claims and the several views illustrated in the accompanying drawings.

FIG. 3 is a fragmentary enlarged vertical sectional view taken along the line 3—3 of FIG. 1 and shows the specific mounting of one set of support arms and the drive mechanism therefor.

FIG. 5 is an enlarged fragmentary horizontal sectional view taken generally along the line 5—5 of FIG. 4 and shows further the details of the mounting of the support arms and the cams for positioning the same.

Figure 1:
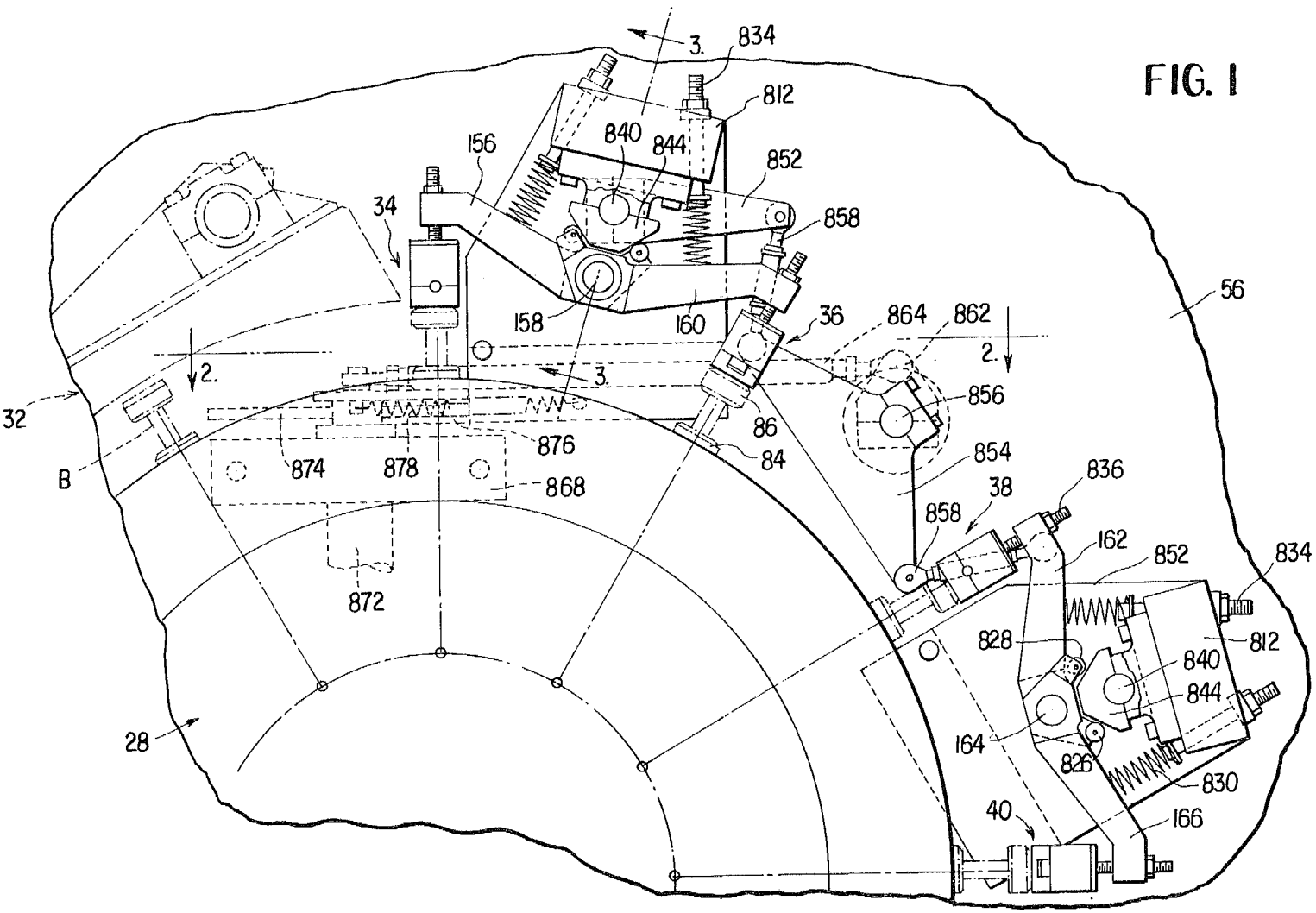
FIG. 1 is a fragmentary elevational view of the heat sealing and cooling devices and the support and drive mechanism therefor in association with the turret which is shown in phantom lines.

Referring now to the drawings in detail, it will be seen that in FIG. 1 there is illustrated schematically the turret 28 and the series of bag supporting mandrels 84, 86 carried thereby. A tubular bag member B having a sealed outer end first passes the plow 32 so as to shape the bag bottom and then sequentially is indexed to be operated on by the heat sealer 34, the cooler 36, the heat sealer 38 and then the cooler 40 so as to form a completely sealed bottom.

Although in FIG. 1 there are illustrated the means for forming only one bag, actually there are two rows of the mandrels 84, 86 which are simultaneously operated on. As a result, there are two each of the heat sealers 34 and 38, the coolers 36 and 40 and the support arms therefor.

Referring specifically to FIGS. 3 and 5, it will be seen that the wall or plate 56 has suitably secured to the front face thereof a spacer block 810 which, in turn, has extending therefrom normal to the plane of the wall 56 a support plate 812. The support plate 812 has depending therefrom an inner support 814 and an outer support 816. The pivot shaft 158 is fixedly secured within and extends between the plates 814, 816, as is clearly shown in FIG. 3.

The support arms 160 and 156 are mounted on the pivot shaft 158 for pivotal movement in spaced relation longitudinally of the pivot shaft with there being a spacer 818 disposed therebetween. Further, the two sets of support arms 156, 160 are spaced apart longitudinally of the pivot shaft 158 by a compression spring 820.

Figure 4:
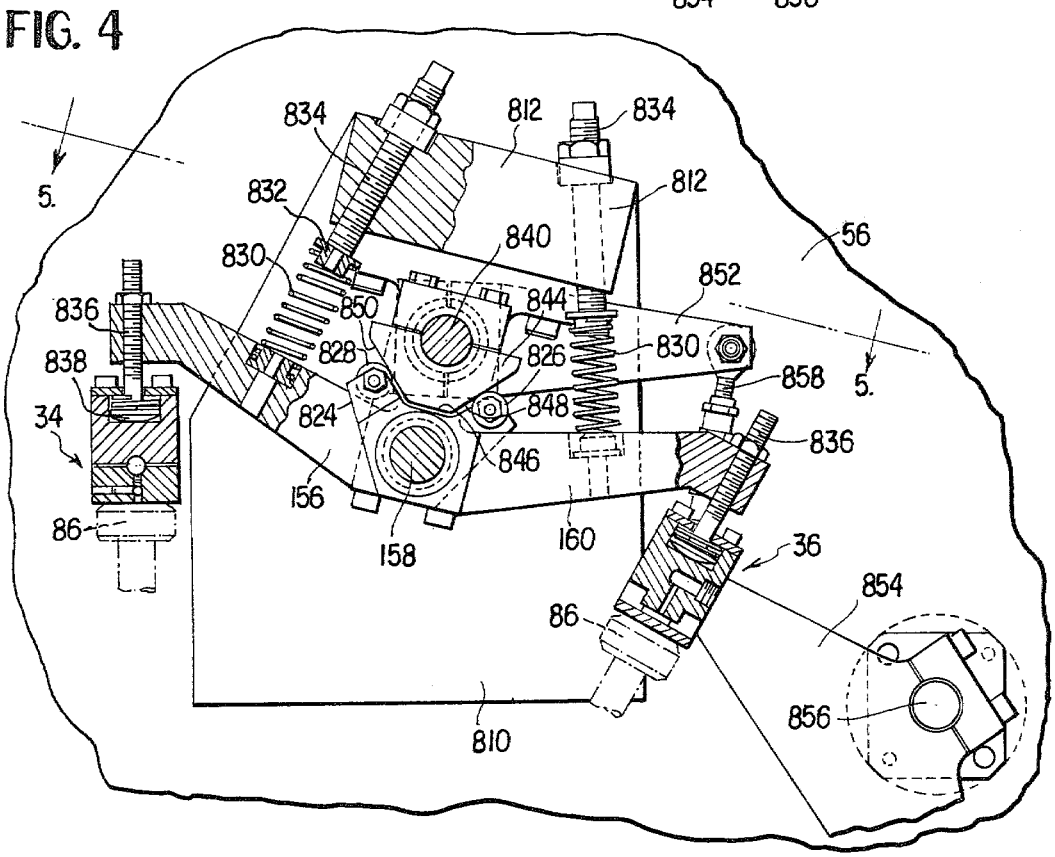
FIG. 4 is an enlarged fragmentary vertical sectional view taken generally along the line 4—4 of FIG. 3 and shows further the specific mounting of the support arms and the manner in which they are positioned.

Referring now specifically to FIG. 4, it will be seen that the support arms 156, 160 have extensions 822, 824 on the side of the pivot shaft 158 opposite from the major portions of the arms. The extensions 822, 824 carry cam followers 824, 828, respectively, which lie in a common plane with the spacer 818. This is clearly shown in FIG. 5.

It will also be apparent from FIG. 4 that each of the support arms 156, 160 is urged towards the center of the turret by a compression spring 830 which is adjustably compressed between the respective support arm and an adjustably mounted stop member 832 which is part of a bolt 834 which is threaded into the support bar 812. Further, it will be seen that the heat sealer 34 and the cooler 36 are adjustably carried by the ends of the respective support arms 156, 160 by support bolts 836 which are adjustable in the respective arms and which have a resilient connection 838 with the respective heat sealer and cooler.

While the heat sealers 34 and the coolers 36, as well as the heat sealers 38 and the coolers 40 are constantly resiliently urged to positions cooperative with the mandrels 86, in accordance with this invention there is provided a positioning mechanism for periodically moving the heat sealers and coolers away from the mandrels 86 during the time which the turret 28 is indexing. The positioning mechanism includes a positioning or drive shaft 840 which is located radially outwardly of the pivot shaft 158 and parallel thereto. The shaft 840, as is best shown in FIG. 3, is rotatably journalled in bearings 842 carried by the supports 814, 816.

The shaft 840 has adjustably clamped thereto a pair of cams 844 which are aligned with the spacers 818 and the cam followers 826, 828. Such cam 844 is of a wedge shape and includes a neutral central portion 846 and two straight sloping portions 848 and 850 which are associated with the cam followers 826, 828, respectively.

Reference is now made to FIG. 1 wherein it will be seen that there is a like positioning mechanism for the heat sealers 38 and coolers 40. Inasmuch as the positioning mechanism is identical with that described relative to the heat sealers 34 and the coolers 36, no further attempt will be made to describe the same and like reference numerals will be applied to like parts thereof.

The two positioning mechanisms are actuated in unison. To this end each of the shafts 840 is provided with a lever 852, the two levers extending in opposite directions and towards one another. The levers 852 are positioned by means of a double ended lever or crank 854 which is carried by a positioning or control shaft 856. The ends of the lever 854 are connected to the levers 852 by adjustable links 858.

Figure 2:
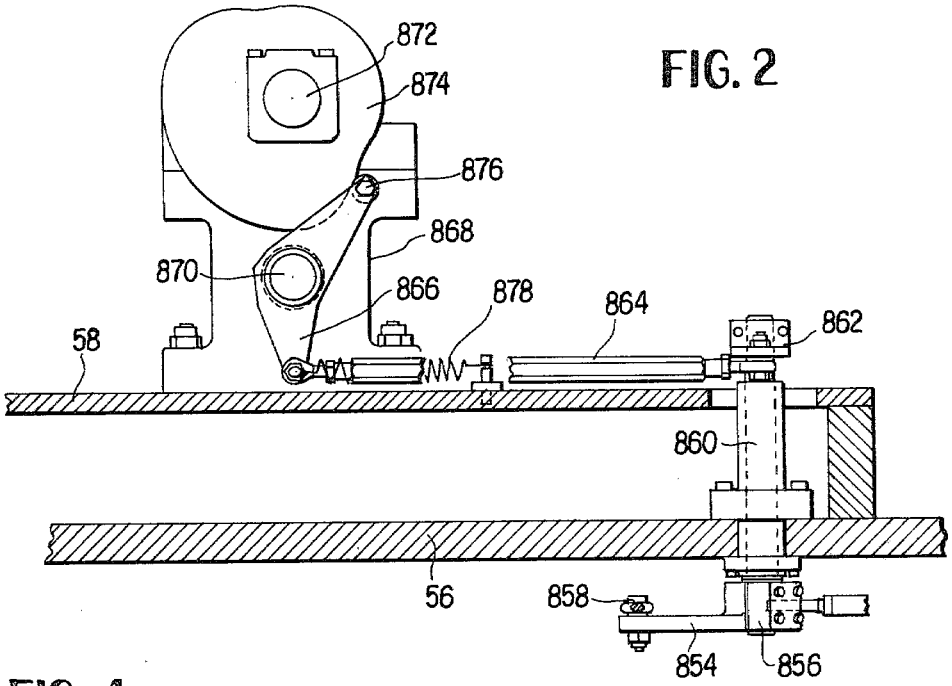
FIG. 2 is a horizontal sectional view taken generally along the line 2—2 of FIG. 1 and shows specifically the details of the cam actuated main drive.

Referring now to FIG. 2, it will be seen that the shaft 856 extends through the wall 56 and through the further wall 858 and is rotatably journalled in a bearing sleeve 860 secured to the rear of the wall 56. The rear end of the shaft 856 is provided with a fitting 862 to which there is connected a link 864 which, in turn, is connected to a bell crank 866.

The wall 58 has mounted thereon a horizontally projecting support 868 which carries a pivot shaft 870 for the bell crank 866. The support 868 also carries a vertical drive shaft 872 of the machine which carries a cam 874. The cam 874 is engaged by a cam follower 876 carried by the opposite end of the bell crank. The cam follower 876 is held against the cam 874 by a tension spring 878.

Referring to FIG. 1 and assuming the cam 874 is rotating in a counterclockwise direction, it will be seen that as the double ended lever 854 is rotated in a clockwise direction, it will cause rotation of the two shafts 840 in a counterclockwise direction with the resultant pivoting of the cams 844 in that direction. The rotation of the cams 844 will serve to wedge the cam followers 826, 828 apart with the support arms 156, 162 pivoting in a clockwise direction to move the heat sealers 34, 38 away from the turret and the support arms 160, 166 in a counterclockwise direction to move the coolers 36, 40 away from the turret.

It will also be readily apparent that while the positioning mechanisms and the drive therefor are very simple, the mechanisms are readily adjustable and can provide the desired synchronization of the positioning of the heat sealers and coolers relative to the mandrels 86 as the turret 28 is indexed.

Although only a preferred drive and positioning mechanism has been specifically illustrated and described herein, it is to be understood that minor variations may be made in the drive and positioning mechanisms without departing from the spirit and scope of the invention as defined by the appended claims.

I claim:

1. A mechanism comprising a pair of pivotally mounted arms, and a drive mechanism for sequentially moving said arms to operative and inoperative positions, said drive mechanism including each of said arms having a control portion, a drive shaft, and a cam carried by said drive shaft, said cam having separate segments cooperating with said control portions, there are two sets of said arms each having one of said drive mechanisms, a control shaft mounted between said sets of arms, and control means carried by said control shaft and connected to said drive shafts for simultaneously actuating said drive shafts, said control means including a double ended lever carried by said control shaft and a single lever carried by each drive shaft.

2. A mechanism comprising a pair of pivotally mounted arms, and a drive mechanism for sequentially moving said arms to operative and inoperative positions, said drive mechanism including each of said arms having a control portion, a drive shaft, and a cam carried by said drive shaft, said cam having separate segments cooperating with said control portions, said cam having a central neutral portion and an active portion on each side of said neutral portion, said active portions being mirrow images of one another and said arms are pivoted in opposite rotational sense when said cam is rotated.

3. A mechanism according to claim 2 wherein said cam is generally in the shape of a wedge.

4. A mechanism according to claim 2 wherein said mechanism is part of a bag closing device, and one of said arms carries a heating element and the other of said arms carries a cooling element, said bag closing device including an indexing turret having separate stations aligned with said heating element and said cooling element.

5. A mechanism according to claim 2 wherein there are two sets of said arms each having one of said drive mechanisms, a single control shaft mounted between said sets of arms, and control means carried by said control shaft and connected to said drive shafts for simultaneously actuating said drive shafts.

6. A mechanism according to claim 2 wherein there are two sets of said arms each having one of said drive mechanisms, a single control shaft mounted between said sets of arms, and control means carried by said control shaft and connected to said drive shafts for simultaneously actuating said drive shafts in a like direction.

7. A mechanism according to claim 2 wherein said mechanism is part of a bag closing device, and one of said arms carries a heating element and the other of said arms carries a cooling element.

8. A mechanism according to claim 6 wherein each set of arms includes a first arm and a second arm, and said control means and said drive mechanisms impart like simultaneous movement to said first arms and like simultaneous movement to said second arms.

9. A mechanism according to claim 2 wherein there are two sets of said arms all mounted for pivoting about a common axis, said drive shaft extends parallel to said common axis, and there is a separate one of said control cam for each set of said arms carried by said drive shaft.

* * * * *